United States Patent [19]

Robinson et al.

[11] 4,020,728

[45] May 3, 1977

[54] ELECTRONIC ORGAN WITH AUTOMATIC KEYING OF PEDAL NOTES

[75] Inventors: John William Robinson; Patrick King Doane, both of Jasper, Ind.

[73] Assignee: Kimball International, Inc., Jasper, Ind.

[22] Filed: Oct. 24, 1975

[21] Appl. No.: 625,528

[52] U.S. Cl. ..... 84/1.03; 84/DIG. 12; 84/DIG. 25

[51] Int. Cl.[2] ..... G10H 1/00; G10H 5/00

[58] Field of Search ..... 84/1.01, 1.03, 1.17, 84/1.24, DIG. 12, DIG. 22, DIG. 25

[56] References Cited

UNITED STATES PATENTS

| | | | |
|---|---|---|---|
| 3,546,355 | 12/1970 | Maynard | 84/1.03 |
| 3,629,480 | 12/1971 | Harris | 84/1.03 |
| 3,795,755 | 3/1974 | Uchiyama | 84/1.03 |
| 3,941,024 | 3/1976 | Brand et al. | 84/1.01 |

*Primary Examiner*—Stanley J. Witkowski
*Attorney, Agent, or Firm*—Melvin A. Crosby

[57] ABSTRACT

An electronic organ having an automatic pedal keying circuit in which a selected pattern of pedal voice notes is played in response to depression of only a single key, which may be a pedal key. When the automatic circuit is effective, normal pedal voice keying operations are disabled, and pedal voices will be keyed in a selected pattern occurring in a timed sequence. The organ is selectively adjustable between a normal playing mode and the playing mode according to the present invention.

21 Claims, 5 Drawing Figures

END 3/4 END 4/4

| MASTERCLOCK | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|---|---|---|---|---|---|---|---|---|---|---|---|
| 3/4 PULSES | X | | X | | X | | X | | | | | X | X | | X | | X | | X | | | | | X | | | | | | |
| 4/4 PULSES | X | | | | X | | X | | X | | | | X | | | | X | | | | X | | X | | X | | | | X | |
| PATTERN ROCK | $C_L$ | | | | | | $D^{\#}$ | | E | | | | G | | | | $C_L$ | | | | | | $D^{\#}$ | | E | | | | G | |
| PATTERN BOOGIE | $C_L$ | | | | E | | | | G | | | | A | | | | $A^{\#}$ | | | | A | | | | G | | | | E | |
| PATTERN LATIN | $C_L$ | | | | | | | | A | | | | G | | | | $C_L$ | | | | | | | | A | | | | G | |
| PATTERN WALTZ | $C_H$ | | | | | | | | | | | $F^{\#}$ | G | | | | | | | | | | | B | | | | | | |

ELECTRONIC ORGAN WITH AUTOMATIC KEYING OF PEDAL NOTES

The present invention relates to electronic organs and is particularly concerned with a special electronic organ circuit which, when effective, causes the sounding of rhythmic bass patterns automatically in response to the depressing of a respective key.

In a conventional electronic organ, the depressing of a key of any of the solo and accompaniment and pedal manuals will actuate a respective keyer. Various arrangements have been arrived at, from time to time, for effecting automatic actuation of keyers in response to the depression of one or more keys of the keyboards with such automatic keyer actuation sometimes being under the control of timing circuitry.

The present invention proposes a sophisticated arrangement in which, when the specialized circuitry of the present invention is effective, effects the sequential sounding of pedal tones according to a predetermined rhythmic time pattern in response to the depressing of a respective pedal key. When the special circuitry of the present invention is effective, the normal pedal circuitry of the organic is made ineffective.

With the foregoing in mind, a primary objective of the present invention is the provision of a special circuit arrangement for incorporation in an electronic organic which, when effective, is operable to produce rhythmic bass patterns upon the depression of a respective pedal key.

Another object of the present invention is the provision of circuitry of the nature referred to above which is made up of relatively simple components which are readily available and which can readily be incorporated in a circuit according to the present invention.

The exact nature of the present invention will become more apparent upon reference to the following detailed specification taken in connection with the accompanying drawings in which.

BRIEF SUMMARY OF THE INVENTION:

According to the present invention, the notes of a group of pedal notes, selected by depressing of a respective pedal key, are sounded in succession according to predetermined selectable rhythm patterns for example, according to Rock, Latin, Boogie, or Waltz patterns. Other rhythm patterns can be selected.

A source of pulses, which can be derived from a rhythm unit forming a part of the organ is employed, via suitable circuit components, for routing enabling signals to pedal keyers on the counts desired in conformity with the selected rhythm pattern.

The keyers, in turn, supply tone signals via voice circuits and amplifier means to a speaker.

The source of pulses is also operable, jointly with the pedal keys, to select the pedal notes to be played on the respective counts and this is accomplished via a matrix of gate elements under the joint control of a switch which is adjusted to select the desired rhythm pattern and pulses which are initiated by pulses from the rhythm unit via appropriate circuitry.

The output from the matrix of gate elements and an encoded signal from the pedal keyboard, control a bank of decoders having outputs connected in controlling relation to a first set of gates which gate, or key, tone signals in the form of 4 foot square waves. The 4 foot signals thus supplied are divided down to 8 foot and 16 foot signals and are supplied to respective busses via second keyers which are under the control of the pedal keys.

An organ embodying the present invention is a conventional organ, having solo, accompaniment, and pedal keyboards, and can be played in a conventional manner, with each key controlling a keyer for a respective tone. The organ is, however, provided with special circuitry according to the present invention which, when effective, will disable at least the pedal keyboard for normal operation and will, instead, permit playing of the organ with an automatic rhythmic bass, or pedal section, which is initiated by the depressing of a single pedal key, or, in the case of an organ, according to U.S. Pat. No. 3,708,604, by the depressing of a single chord playing key of the accompaniment manual of the organ.

In the present invention, a source of rhythm pulses in ¾ time and source in 4/4 time is provided and for each rhythm pattern, a single one of the sources is selected and is operable for controlling the operation of the circuit, including the counts on which pedal notes sound.

The circuitry of the present invention employs integrated circuit techniques and, in most instances, negative logic.

DETAILED DESCRIPTION OF THE INVENTION

Figure 1:
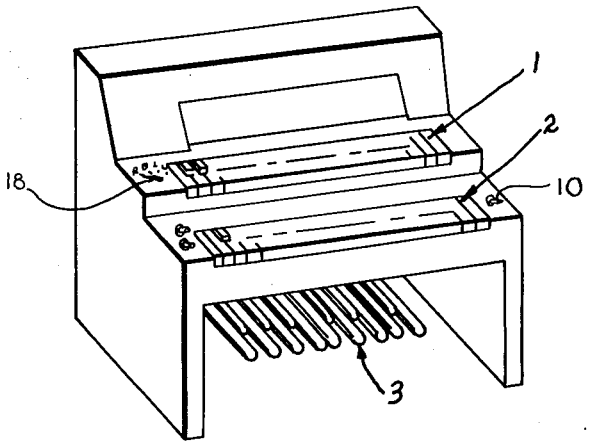
FIG. 1 is a schematic showing of an organ embodying the present invention.

Referring to the drawings somewhat more in detail, and with particular reference to FIG. 1, the electronic organ schematically illustrated therein has a solo manual 1 consisting of conventional keys, an accompaniment manual 2 also consisting of keys and a pedal manual, or clavier, 3, having keys or pedals. When the organ plays in a conventional mode, each of the aforementioned keys, when depressed, will actuate a keyer which will permit a respective tone signal to pass from a tone generator through a keyer and through amplifier and voicing circuits to a speaker.

The conventional organ circuitry referred to is well known and is not illustrated or described in detail in the present invention, and application.

The organ is, however, provided with switches at 10 and 18 which control the special circuitry which is illustrated and described in detail herein.

Figure 2:
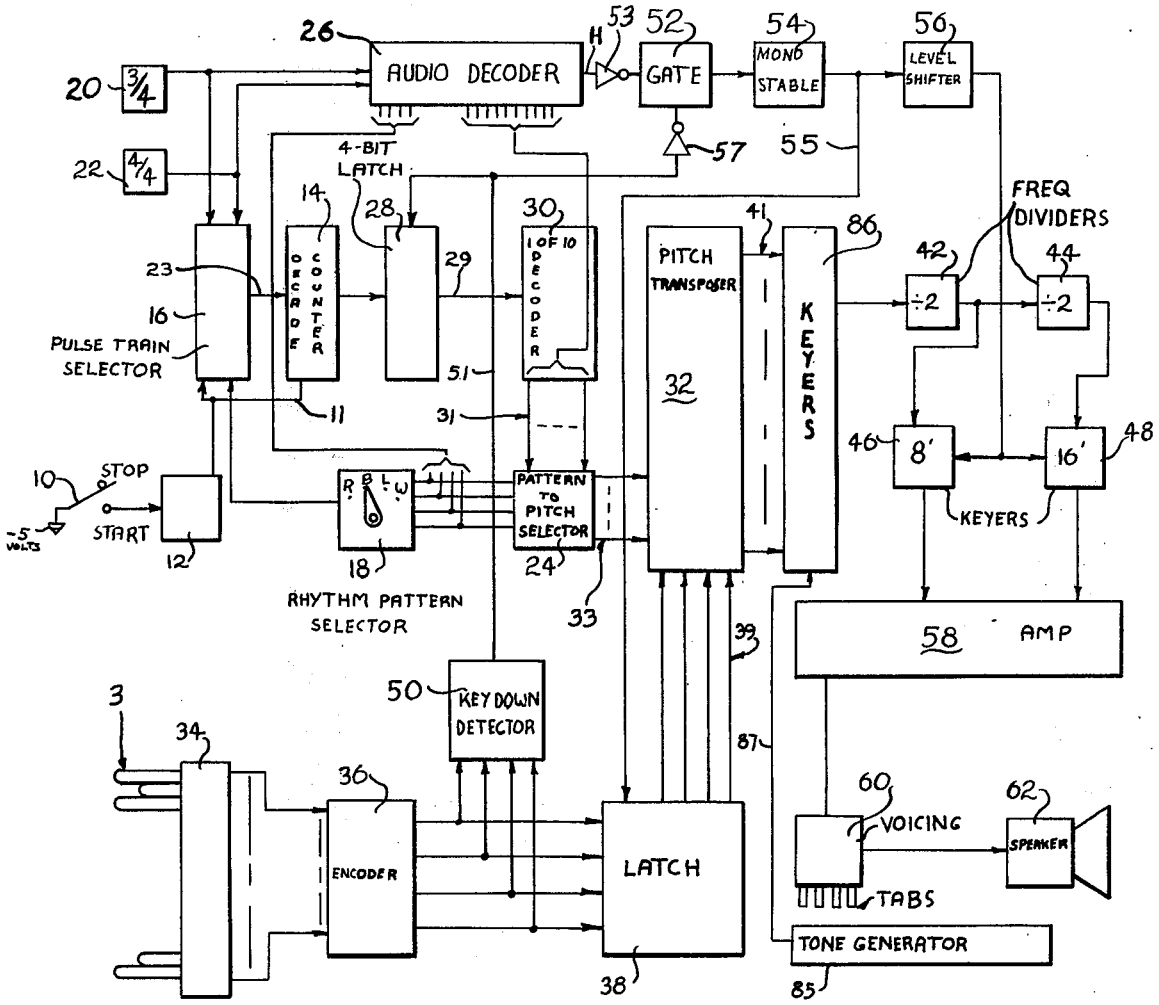
FIG. 2 is a simplified block diagram of the circuit of the present invention.

Refering to FIG. 2, the switch 10 is a manually operable startstop switch which is adapted, when closed, to activate an enabling circuit 12 which, in turn, supplies an enabling signal to a decade counter 14 and to pulse train selector 16. A four position pattern selecting switch 18, in one position, provides a further signal to pulse train selector 16. Selector 16 passes one only of the two inputs 20 and 22 to the output line 23 leading to the clocking input of decade counter 14, depending on the respective position of switch 18.

Inputs 20 and 22 of selector 16 are in the form of pulse trains derived, for example, from a rhythm unit forming a part of the organ. The pulse supply at 20 is in ¾ time, while the pulse supply at 22 is 4/4 time.

Specifically, when switch 10 is actuated, pulse train 22 in 4/4 time is selected unless switch 18 is in Waltz (W) position and, in which case, pulse train 20 in ¾ time is selected. Switch 18, as will be seen, has Rock (R), Latin (L), Boogie (B), and Waltz (W) positions and in the first three named positions does not influence the pulse train selection while in the last named, Waltz (W), position effects, as mentioned, the selection of the ¾ time train of pulses, 20. The pulses supplied at 20 and 22 are also used in an audio decoding circuit 26.

Figures 3, 5:
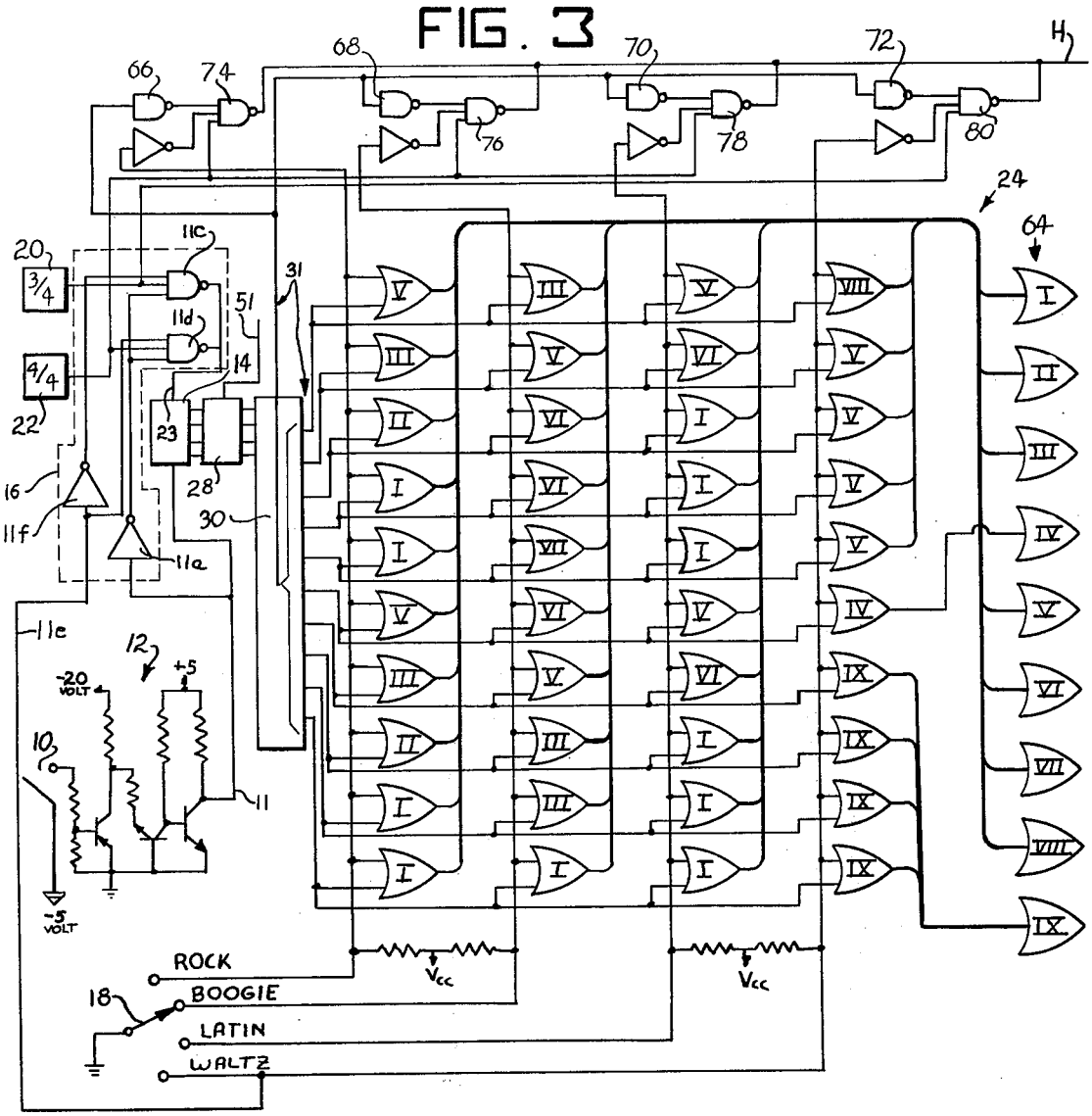
FIG. 3 is a schematic diagram, showing a portion of the circuit of the present invention.
FIG. 5 is a chart indicating the relative timing of two pulse trains used in the present invention and the notes sounded in the pedal voice for each of the patterns in response to the depression of the low C pedal.

Referring now to FIG. 3, when switch 10 is closed, wire 11 goes low and enables counter 14 and, via invertor 11*a*, supplies a 1 to one input terminal of each of NAND gates 11*c* and 11*d*. When switch 18 is in Waltz position only, wire 11*e* goes low and supplies a 0 to one input terminal of gate 11*d* and, via inverter 11*f*, supplies a 1 to one input terminal of gate 11*c*. The third input terminal of each of gates 11*c*, 11*d* is supplied by pulse trains from the respective sources 20, 22. It will be seen that due to the described circuitry only one of gates 11*c*, 11*d*, is effective at one time.

Pattern selector switch 18 in each position thereof also enables a respective portion of a pattern-to-pitch selector 24 for a purpose to be explained.

The output side of decade counter 14 is connected to the input side of a four-bit latch 28. Latch 28 normally passes data unimpededly but when the clock line goes low, data is clamped in the latch. The output 29 of latch 28 is used as the input to a one of ten decoder 30, which enables one of ten outputs in response to a respective input received from latch 28.

Specifically, when an output of decoder 30 is enabled it goes low (0) and, when not enabled, stays high (1). The outputs of one of ten decoder 30 serve two purposes: firstly, the outputs 31 of decoder 30 are used to enable portions of the pattern-to-pitch selector 24, and secondly, to enable portions of the audio decoding circuit 26.

The output 33 of pattern-to-pitch selector 24 are supplied as inputs to a pitch transposer 32. The signal from pedal keyboard 34 is encoded into a four-bit binary digital signal by an encoder 36. Encoder 36 will produce a four bit binary word at the output whenever a pedal is depressed, with the binary word thus developed indicating which pedal has been depressed. Encoder 36 also provides a binary word whenever no pedals are depressed. The digital output of pedal board encoder 36 is supplid to and is memorized by a four-bit latch 38.

The outputs 39 of latch 38 are used as a further input to pitch transposer 32, while the outputs 41 of pitch transposer 32 are supplied via appropriate gating 84 (FIG. 4) to pitch switches, or gates, 86 which are operable for keying respecting 4-foot pitches covering a range of, say, 25 scale notes. The tone generator 85 supplies the tone signals to the respective keyers at 86 via a cable 87, it being understood that a single output terminal of generator 85 is connected to the input side of a respective keyer by a pertaining wire of cable 87.

The particular number of pitches thus keyed can, of course, be varied. The outputs of gates 86 are fed to the frequency dividing circuitry consisting of serially connected frequency dividers 42 and 44, and wherein the 4 foot signals are divided to produce 8 foot signals and 16 foot signals which are then supplied to the inputs of keyers 46 and 48, respectively, and from which keyers, signals are supplied to the voicing means 58, amplifier means 60, and speaker means 62 of the organ.

The binary output of pedal board encoder 36 is also fed to a pedal down detect circuit 50 which produces an enabling output whenever any pedal in the pedal board is depressed. The enabling output of pedal down detect circuit 50 is supplied by wire 51 and invertor 57 to the control terminal of a gate 52 to enable the gate whenever a key is depressed. The detect circuit supplies a (0) to the clock input of latch 28 to clamp data therein when no key in the pedal keyboard is depressed.

An enabling input to gate 52 from pedal down detect circuit 50 allows the output from audio decoder circuit 26 to pass to a monostable multivibrator 54. The output of multivibrator 54 is fed through a buffering and shaping circuit 56 for control of attack and decay to the control terminals of the 8 foot and 16 foot keyers 46 and 48, respectively. The outputs of keyers 46 and 48, as mentioned, are supplied to buss means leading to conventional voicing, amplifier and transducer circuits 58, 60 and 62, respectively.

The output of multivibrator 54, supplied to wire 55, also forms the clocking input to four bit latch 38 which, as mentioned, is connected to the output of pedal board encoding circuit 36. Thus, the output of pedal board encoder 36 is memorized each time the audio decoder circuit 26 causes multivibrator 54 to pulse.

The pattern to pitch selector circuit 24, shown in more detail in FIG. 3, consists of a matrix of OR gates made up of four groups, or columns, of OR gates, with each of the groups consisting of ten OR gates. The gates of the four columns of gates are distributed in ten rows with four gates in each row. Each gate has two inputs with one input of each gate in a respective column interconnected while the other input of each gate is interconnected with those of the other gates in the same row.

All of the gates of one of the columns of OR gates has an enabling signal (0) supplied to the said one input thereof for each position of pattern select switch 18.

On the other hand, the outputs of one of ten decoder 30 supply an enabling signal (0) to the said other input of the gates of a respective row thereof, namely, to the other input of one OR gate in each of the four columns of OR gates for each input signal to the decoder. Thus, for each position of pattern selector switch 19, each of the ten possible outputs of decade counter 14, will enable one OR gate only in the pattern to pitch selector circuit 24. When one of the gates of circuit 24 is enabled, the output goes low (0).

Each of the OR gates in the pattern-to-pitch selector circuit 24, as shown in FIG. 3, is marked with a roman numeral.

Specifically, the outputs of similarly marked ones of the gates of the pattern-to-pitch selector 24 are connected together or are supplied as inputs to correspondingly marked OR gates 64, each having an output connected to the enabling input of a respective one of the one of 16 decoders of the pitch transposer 32. The gates 64 are marked with the same roman numeral designation as is applied to the gates of the matrix 24 which have the outputs interconnected and connected to the input of the respective gate 64.

The audio decoding circuit 26 will be seen in FIG. 3 to comprise a group of NAND gates at 66, 68, 70 and 72, and a further group also NAND gates at 74, 76, 78 and 80. Selected ones of the outputs 31 of one of ten decoder 30 are used as inputs to respective ones of NAND gates, 66, 68, 70 and 72.

Each of NAND gates 66, 68, 70 and 72 has multiple inputs which are so connected to the outputs 31 of decoder 30 that the respective gate output stays high (1) except on certain counts of decoder 30. Thus, gate 66 for the Rock pattern is connected so the output goes high (1) on counts 1, 3, 4, 5, 6, 8, 9 and 10 of the 4/4 pulse train and low (0) on counts 2 and 7. For gate 68 for the Boogie pattern, the output goes high (1) on counts 1, 2, 4, 5, 7, 9 and 10 of the 4/4 pulse train and low (0) on counts 3 and 8, while the output of gate 70 for the Latin pattern goes high (1) on counts 1, 4, 5, 6, 9 and 10 of the 4/4 pulse train and low (0) on counts 2, 3, 7 and 8. Gate 72 for the Waltz pattern is connected so the output goes high (1) on counts 1, 5, 6 and 10 of the ¾ pulse train and low (0) on counts 2, 3, 4, 7, 8 and 9. This relationship is illustrated in FIG. 5 wherein the ¾ and 4/4 pulse trains are marked with Xs and the notes played for the selective rhythm pattern when a C pedal is depressed are marked below the respective Xs.

Each pulse train pattern will be seen to be made up of ten counts, denoted by Xs in FIG. 5. By using ten counts for each pulse pattern, a decade counter can be used at counter 14.

Each of gates 66, 68, 70, 72 has the output forming one input of gate 74, 76, 78 and 80, respectively. A second input to NAND gates 74, 76, 78 and 80 is from a respective invertor supplied by a pattern selector switch 18, with the switch providing an enabling level (1) signal to a respective one only of these NAND gates for each of the four positions of switch 18. The third input of each of NAND gates 74, 76 and 78 is from the 4/4 pulse train input 22, while the third input to NAND gate 80 is from the ¾ pulse train input 20. The output sides of gates 74, 76, 78 and 80 are connected to a wire marked H in FIG. 3 which goes low whenever the output of any of the gates 74, 76, 78 and 80 connected thereto goes low.

It will be seen that gate 74, for example, is enabled to cause the output to go low (0) only when switch 18 is in the Rock position, and on respective pulses of the 4/4 pulse train 22 identified above, and when the output of gate 66 is high (1).

Gate 76 is similarly under the control of switch 18 in the Boogie position, the above identified pulses of the 4/4 pulse train, and gate 68.

Gate 78 is similarly under the control of switch 18 in the Latin position, the above identified pulses of the 4/4 pulse train, and gate 70.

Gate 80 is similarly under the control of switch 18 in the Waltz position, the above identified pulses of the ¾ pulse train, and gate 72.

From FIG. 5, it will be seen that each of 4/4 pulse train 22 and ¾ pulse train 20 utilizes ten pulses before repeating, thus accommodating the system to the use of decade counter 14.

The time relation between the counts on which the outputs of gates 74, 76, 78 and 80 are enabled (go low) and the respective counts of the selected pulse train can be seen in FIG. 5. The pulses of the respective pulse trains are marked X in FIG. 5 and the counts on which the outputs of gates 74, 76, 78, 80 go low and notes sound are indicated by the note markings thereabeneath. As has been mentioned, the notes indicated in FIG. 5 are the notes which are played when the low C pedal is depressed.

Figure 4:
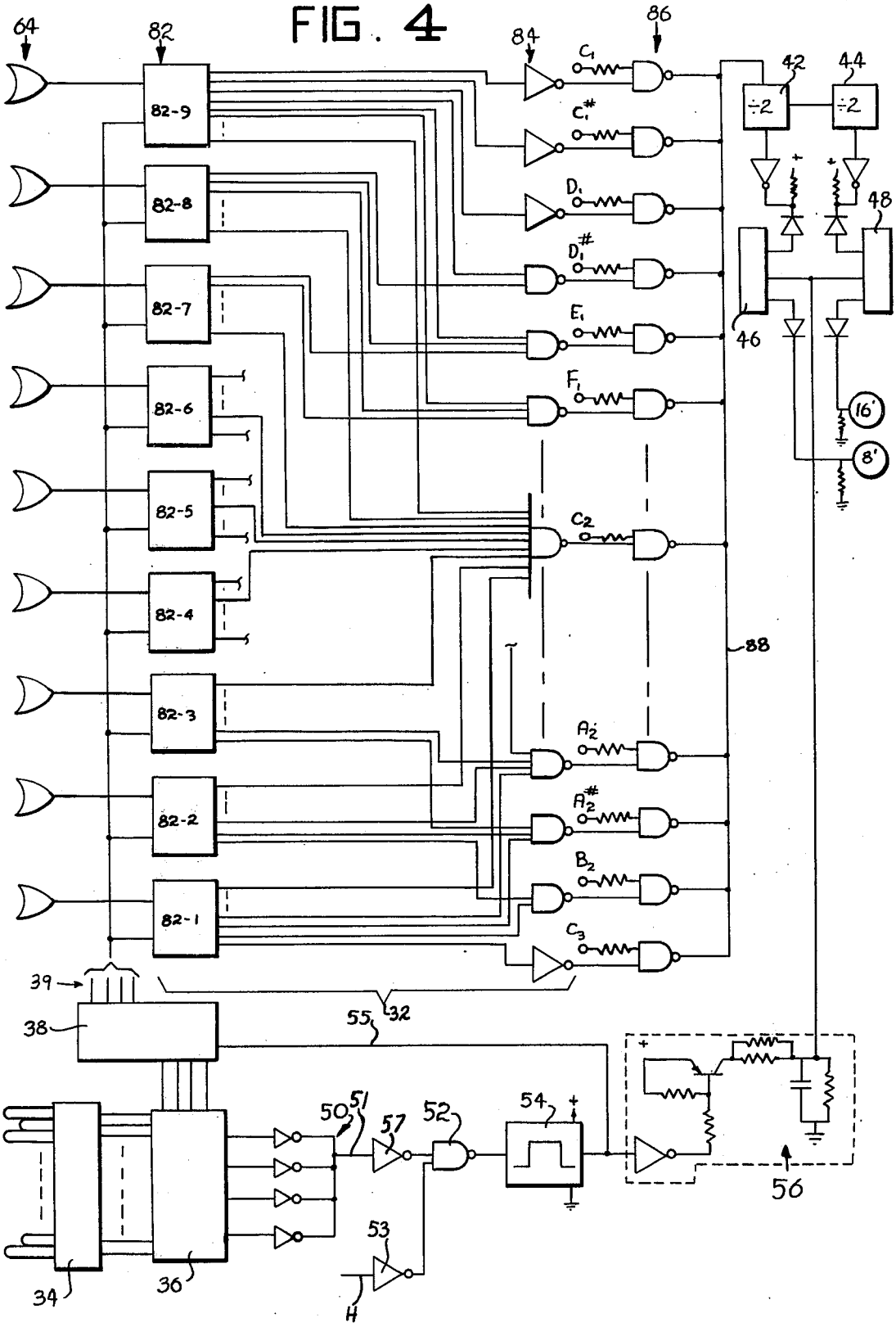
FIG. 4 is also a schematic of a portion of the circuit of the present invention.

The outputs of the aforementioned OR gates indicated at 64 in FIGS. 3 and 4 are used as enabling inputs to a series of nine one-of-sixteen decoders 82, each utilizing thirteen of the output terminals.

The outputs of pedal board encoder 36 are used as addressing inputs to each of the group of nine one-of-sixteen decoders 82, causing each to enable, namely, drive low, a respective one of the thirteen outputs utilized whenever the respective decoder is enabled from the pattern to pitch selector 24 via the the respective gate 64. Each output of each of the one-of-sixteen decoders 82 is connected to an input of a respective one of a series of 25 signal transmitting components indicated at 84 and consisting of NAND gates and inverters and having outputs on which signals (1) appear whenever an input thereof goes low due to a signal from the one-of-sixteen decoders. Specifically, a component 84 is considered enabled when the output goes high (1).

Each of components 84 has the output connected to a keyer to be enabled thereby. The inputs of components 84, in some cases consisting of a single input and in other cases of multiple inputs, are connected to the output terminals of the decoders 82 in conformity with the following schedule.

In the schedule, the decoders are marked 82-1 through 82-9 and the note designation in the columns beneath each decoder number represents an input to the correspondingly designated component 84.

For example, the component 84 for note C2, which is midway in the range of notes to be keyed, is a NAND gate having nine inputs, one pertaining to each decoder as will be seen in the schedule. Component 84 for note C1 which is at the bottom of the range of notes, is, on the other hand, an inverter and has only a single input connected to an output of decoder 82-9, as shown in the schedule. Similarly, for uppermost note C3 which is also an inverter which has a single input connected to an output of decoder 82-1.

SCHEDULE

| 82-1 | 82-2 | 82-3 | 82-4 | 82-5 | 82-6 | 82-7 | 82-8 | 82-9 |
|---|---|---|---|---|---|---|---|---|
| C2 | B1 | A#1 | A1 | G | F#1 | E1 | D#1 | C1 |
| C#2 | C2 | B1 | A#1 | G#1 | G1 | F1 | E1 | C#1 |
| D2 | C#2 | C2 | B1 | A1 | G#1 | F#1 | F1 | D1 |
| D# | D2 | C#2 | C2 | A#1 | A1 | G1 | F#1 | D#1 |
| E2 | D#2 | D2 | C#2 | B1 | A#1 | G#1 | G1 | E1 |
| F2 | E2 | D#2 | D2 | C2 | B1 | A1 | G#1 | F1 |
| F#2 | F2 | E2 | D#2 | C#2 | C2 | A#1 | A1 | F#1 |
| G2 | F#2 | F2 | E2 | D2 | C#2 | B1 | A#1 | G1 |
| G#2 | G2 | F#2 | F2 | D#2 | D2 | C2 | B1 | G#1 |
| A2 | G#2 | G2 | F#2 | E2 | D#2 | C#2 | C2 | A1 |

SCHEDULE-continued

| 82-1 | 82-2 | 82-3 | 82-4 | 82-5 | 82-6 | 82-7 | 82-8 | 82-9 |
|---|---|---|---|---|---|---|---|---|
| $A^{\#}2$ | A2 | $G^{\#}2$ | G2 | F2 | E2 | D2 | $C^{\#}2$ | $A^{\#}1$ |
| B2 | $A^{\#}2$ | A2 | $G^{\#}2$ | $F^{\#}2$ | F2 | $D^{\#}2$ | D2 | B1 |
| C3 | B2 | $A^{\#}2$ | A2 | G2 | $F^{\#}2$ | E2 | $D^{\#}2$ | C2 |

The outputs of components 84 serve as keying signals to a series of 25 NAND gates generally indicated at 86. The second input to each of the gates 86 is a 4 foot square wave with the pitches distributed over a range of two octaves plus a single note, say, from a C note to the C note two octaves higher. The second inputs to keyers 86, and which are marked with note designations, make up the cable 87 leading to tone generator 85.

When the output of one of the gates at 84 is enabled, namely, goes high, it enables the corresponding NAND gate at 86, for passing the four foot square wave frequency to the common output buss 88, and from there to the frequency dividers 42 and 44. The output of frequency divider 42 corresponds to 8 foot tones and is delivered to keyer 46. The output of frequency divider 44 corresponds to 16 foot tones and is delivered to keyer 48.

The pedal down detect circuit 50, shown in FIG. 4, comprises four inverters receiving signals from encoder 36 and a fifth invertor supplied by the four invertors. The fifth, or output, invertor presents the enabling signal via invertor 57 to one of the inputs of a two input NAND gate 52 whenever a pedal is depressed. The signal to the second input of NAND gate 52 is supplied via inverter 53 from wire H which, as seen in FIG. 3, is the combined outputs of gates 74, 76, 78 and 80 of the audio decoding circuit.

NAND gate 52 will thus have a negative going pulse at the output in conformity with the enabling signal on wire H whenever any of the pedals in the pedal board 34 are depressed. The pulse at the output of gate 52 triggers monostable multivibrator 54, causing it to produce at the output a pulse which triggers a keyer control circuit 56 and thereby actuating keyers 46 and 48 to pass signals to the amplifier-voicing-transducer circuits 58, 60 and 62. The output of monostable multivibrator 54 is also supplied via wire 55 as a clocking input to four bit latch 38 interposed between the output of pedal board encoder 36 and the addressing input of the one-of-sixteen decoders 82.

The provisions of the latches, or memories, in the pedal encoder circuit and in the line between decade counter 14 and decoder 30 hold the information required to prevent a choppy sound as a pedal is released prior to actuation of the next pedal to be depressed.

In summary, an organist may select any of four rhythm patterns by selecting a corresponding position of selector switch 18. Once the selection has been made, and a pedal is depressed in the pedal board, notes will be sounded in the pedal voices in a pattern similar to the patterns displayed in FIG. 5.

The patterns of FIG. 5 show what occurs when the low C pedal is depressed. Depression of any other pedal will move this pattern up a corresponding number of notes along the displayed chart.

The organ can, of course, be played in a conventional manner by making the circuitry of the present invention ineffective, as by opening switch 10, and actuating a respective keyer for each key which is depressed.

In the conventional organ, circuitry not shown herein, each key of the organ keyboards could be connected in controlling relation to a respective keyer connected between a terminal of the tone generator and the amplifier, voicing and speaker system of the organ. In utilizing the circuit of the present invention, at least the normal pedal keyers are disabled and the keyers 86 are enabled. This can be accomplished by switching of a control voltage. If the circuit of the present invention is employed when chord playing keys of the accompaniment manual are effective, the normal pedal keyers are also disabled and keyers 86 are made effective, as before, by switching a control voltage.

The matrix of OR gates at 24 and forming what is referred to as the "pattern-to-pitch selector", merely represents one form of a matrix arrangement that could be employed for this purpose. For example, the matrix could consist of a diode matrix or read only memorys could be employed or other types of signal transmitting components. In each case, the individual components would include two input terminals with individual columns of the matrix arrangement being selectively enabled via one input with the signals to be conveyed being supplied to the other input of the respective components. In any case, it will be appreciated that integrated circuit techniques can be employed for forming a chip corresponding to matrix 24 'pattern-to-pitch selector'.

With reference to the actuating pulses, these are disclosed and described as being derived from respective pulse trains at different tempos but it will be understood that a single course of pulses could be employed while utilizing a pulse stretcher in place of the pulse train selector.

Modifications may be made within the scope of the appended claims.

What is claimed is:

1. The method of playing rhythmic note patterns in an electronic organ having depressable playing keys, a tone generator and electroacoustic means, which comprises; supplying identical trains of rhythmic pulse patterns repetitively, enabling one of a group of decoders on each pulse of each said train, detecting the depressing of a playing key and encoding a signal in conformity with the playing key depressed, supplying the encoded signal to the decoder as an addressing input thereto to enable a respective output of the enabled decoder, actuating a respective first keyer interposed between the tone generator and the electroacoustic means for each enabled output of the decoders to key a respective pitch, and actuating a second keyer interposed between the first keyer and the electroacoustic means on selected ones only of the pulses of each pulse train.

2. The method according to claim 1 which includes selecting one of ¾ time and 4/4 time for the said pulse trains.

3. The method according to claim 1 in which each pulse train consists of 10 pulses.

4. The method according to claim 1 which includes interposing a matrix of two input gates arranged in rows and columns between the pulse train supply and the decoders, supplying each pulse of each train of pulses to one input of the gates of a respective row of the gates, supplying an enabling signal to the other inputs of the gates of a respective column of the gates, and connecting the gate outputs to the enabling inputs of said decoders.

5. In an electronic organ having playing keys, a tone generator developing a plurality of pitches, and electroacoustic means; pulse generating means forming a supply of repetitive rhythmic pulse trains, decoders having enabling inputs, first means connecting said pulse generating means to said inputs for enabling of one decoder on each pulse of each pulse train, each decoder having a plurality of outputs and an addressing input, encoding means connected to said addressing inputs and actuated in response the depression of a playing key to develop and addressing signal in conformity with the respective playing key depressed, each addressing input enabling a respective output of the enabled one of said decoders, first keyers connected to said tone generator for keying respective pitches, second means connecting said decoder outputs to said first keyers for enabling of each said first keyer in response to the enabling of predetermined ones of the decoder outputs, second keyers, third means connecting said second keyers to said first keyers and to said electroacoustic means, and fourth means for enabling said second keyers on predetermined ones only of the pulses of each pulse train.

6. An electronic organ according to claim 5 in which said first means includes a matrix of two input gates arranged in rows and columns and having outputs connected in groups to the enabling inputs of said decoders, a counter actuated by the pulses of the pulse trains, decoder means driven by the counter and having outputs each of which is connected to the inputs of the gates of a respective row thereof, and selector means for selectively supplying enabling signals to the other inputs of the gates in respective columns thereof.

7. An electronic organ according to claim 5 in which said second means comprises a plurality of signal conveying components each operable upon the supply of an enabling signal to the input side to supply a keyer enabling signal at the output side, the input side of each said component being connected to at least one decoder output and the output side being connected to a respective first keyer.

8. An electronic organ according to claim 5 in which said third means includes frequency dividing means between said first keyers and said second keyers.

9. An electronic organ according to claim 5 which includes a counter driven by the pulses of said pulse trains, decoder means driven by the counter and having outputs which are enabled in succession during each said pulse train, said fourth means including gate means having inputs connected to said pulse generating means and to selected outputs of said decoder means, and a monostable multivibrator having the input side connected to the output side of said gate means and an output side connected in actuating relation to said second keyers.

10. An electronic organ according to claim 9 which includes a latch interposed between said encoding means and the addressing inputs of said decoders and having a clock terminal, and means connecting the clock terminal of said latch to the output side of said multivibrator for latching data into the latch upon a transition at the multivibrator output.

11. An electronic organ according to claim 5 which includes means actuated by said encoding means for disabling said fourth means when none of said playing keys is depressed.

12. An electronic organ according to claim 9 which includes a latch interposed between said counter and decoder and normally passing data unimpededly, said latch having a clock terminal responsive to a signal for clamping data in the latch, and means actuated by said encoding means for supplying a data clamping signal to the clock terminal of said latch when none of said playing keys is depressed.

13. An electronic organ having a keyboard with depressable playing keys, a tone generator supplying respective pitches, and electroacoustic means; first keyers connected to the generator for keying respective pitches and second keyers connecting the first keyers to said transducer means, a source of pulses, a counter connected to said source, a first decoder connected to said counter and having outputs which become enabled in succession, matrix of two input gates arranged in rows and columns with one input of the gates in each row connected to a respective output of said first decoder, selector means for supplying an enabling signal to the other input of the gates in each column selectively, the outputs of said gates being interconnected in groups to form a plurality of outputs for said matrix, second decoder means having enabling inputs connected to the outputs of said matrix and outputs connected in actuating relation to said first keyers, said second decoder means having addressing inputs, an encoder actuated by depression of a said playing key and connected to supply signals in conformity with the playing key depressed to the addressing inputs of said second decoder means, audio gate means having inputs connected to said source of pulses and to the outputs of said first decoder and enabled on predetermined ones only of the pulses from said source and the outputs from said first decoder, and means connecting the output sides of said audio gate means in actuating relation to said second keyers.

14. An electronic organ according to claim 13 in which said audio gate means includes a control gate for each column of gates in said matrix, said selector means being connected to said control gates and enabling a respective one thereof for each column of gates of the matrix which is enabled.

15. An electronic organ according to claim 13 in which said source of pulses repetitively supplies a series of 10 pulses, and means connected to said source for selecting one of ¾ and 4/4 time for the repetitive pulse series.

16. An electronic organ according to claim 13 which includes frequency divider means interposed between said first and second keyers.

17. An electronic organ according to claim 13 which includes a gate element and a monostable multivibrator interposed in series in the order named between said audio gate means and said second keyers, a detector connected to said encoder and developing a signal when a playing key is depressed, and means for supplying the key-down signal from said detector to said gate element for enabling said gate element.

18. An electronic organ according to claim 13 which includes a latch interposed between said encoder and the addressing inputs of said second decoder means and having a clocking input, a gate element and a monostable multivibrator interposed in series in the order named between said audio gate means and said second keyers, a detector connected to said encoder and developing a signal when a playing key is depressed, means for supplying the key-down signal from said detector to said gate element for enabling said gate element, and means connecting the output of said multivibrator to the clocking input of said latch.

19. An electronic organ according to claim 17 which includes a latch element between said counter and said first decoder and normally passing data unimpededly, the output of said detector being connected to the latch and clamping data in the latch when the output from said detector indicates that no playing key is depressed.

20. An electronic organ according to claim 13 in which said source of pulses repetitively supplies a series of ten pulses, control means for selecting ¾ time or 4/4 time for the pulse series, and means operated by said selector means for actuating said control means.

21. An electronic organ having a keyboard with playing keys, a tone generator supplying respective pitches, and electroacoustic means; first keyers connected to the generator for keying respective pitches and second keyers connecting the first keyers to said transducer means, a source of pulses, a counter connected to said source, a first decoder connected to said counter and having outputs which become enabled in succession, a matrix of signal conveying components arranged in rows and columns and having one input terminal for each row connected to a respective output of said decoder means for selectively and singly enabling the columns of said components for passing signals supplied to the input terminals by said decoder, said matrix having a plurality of outputs to which signals are supplied by the enabled column of components in conformity with the decoder output signals, a second decoder means having enabling inputs connected to the outputs of said matrix and outputs connected in actuating relation to said first keyers, said second decoder means having addressing inputs, an encoder actuated by depression of a said playing key and connected to the addressing inputs of said second decoding means, audio gate means having inputs connected to said source of pulses and to the outputs of said first decoder and enabled on predetermined ones only of the pulses from said source and the outputs from said first decoder, and means connecting the output sides of said gate means in actuating relation to said second keyers.

* * * * *